United States Patent [19]

Heider

[11] 4,333,570

[45] Jun. 8, 1982

[54] MERCHANDISING PACKAGE FOR CONTAINERS

[75] Inventor: James E. Heider, Toledo, Ohio

[73] Assignee: Owens-Illinois, Inc., Toledo, Ohio

[21] Appl. No.: 129,955

[22] Filed: Mar. 13, 1980

Related U.S. Application Data

[63] Continuation of Ser. No. 694,267, Jun. 9, 1976, abandoned.

[51] Int. Cl.[3] ..... B65D 71/08

[52] U.S. Cl. ..... 206/432; 206/497; 206/604

[58] Field of Search ..... 206/161, 427, 432, 433, 206/434, 497, 628, 45.33, 606, 604; 229/DIG. 12; 428/910

[56] References Cited

U.S. PATENT DOCUMENTS

| | | | |
|---|---|---|---|
| 3,001,644 | 9/1961 | Fourness et al. | 206/606 |
| 3,255,877 | 6/1966 | Kracht et al. | 206/432 |
| 3,273,302 | 9/1966 | Walter | 206/497 X |
| 3,344,975 | 10/1967 | Stoker, Jr. | 206/497 X |
| 3,347,365 | 10/1967 | Funkhouser | 206/139 |
| 3,400,810 | 9/1968 | Makowski | 206/161 |
| 3,403,779 | 10/1968 | Becker et al. | 206/628 X |
| 3,620,898 | 11/1971 | Harris et al. | 428/910 |
| 3,692,232 | 9/1972 | Helms | 206/161 X |
| 3,734,273 | 5/1973 | Watanabe | 206/497 |
| 3,746,160 | 7/1973 | Thompson et al. | 206/45.33 |
| 3,747,749 | 7/1973 | Brown | 206/432 |
| 3,750,876 | 8/1973 | Throberg | 206/432 |
| 3,756,395 | 9/1973 | Ganz | 206/432 |
| 3,788,463 | 1/1974 | Ruff | 206/432 |
| 3,824,139 | 7/1974 | Jay et al. | 674/367 |
| 3,915,933 | 10/1975 | Kohno et al. | 428/910 |
| 3,979,000 | 9/1976 | Karabedian | 428/910 |
| 4,038,446 | 7/1977 | Rhoads | 215/12 R |

FOREIGN PATENT DOCUMENTS

| | | | |
|---|---|---|---|
| 936135 | 10/1973 | Canada | 206/432 |

*Primary Examiner*—Stephen Marcus

*Attorney, Agent, or Firm*—E. J. Holler; M. E. Click; D. H. Wilson

[57] ABSTRACT

Disclosed is a multiple container merchandising package comprising a group of similarly shaped containers held together in side-by-side fashion by a plastic overwrap comprising an opaque, uniaxially oriented, laminated, composite sleeve of thermoplastic foam and a thermoplastic film.

18 Claims, 5 Drawing Figures

MERCHANDISING PACKAGE FOR CONTAINERS

This is a continuation of application Ser. No. 694,267 filed June 9, 1976, now abandoned.

This invention relates to a package for two or more containers such as cans, bottles, jars, cannisters, made of glass, metal, or rigid plastic or paper. In a more specific aspect the present invention relates to an improved merchandising package for a plurality of such containers wherein performance, economy, and appearance of the package are primary considerations.

Today's marketing of bottled and canned beverages and other products calls for suitably packaged clusters of such containers, perhaps the most familiar of which is the so-called "six-pack". The package must safely and firmly hold the containers, it must lend itself both to ready independent portability for consumer use and to bulk stacking for warehousing and shipment, and it must lend itself to reliable and economical mass production. The advent of shrinkable plastic overwraps has resulted in drastic changes from the cardboard packages of the past, and U.S. Pat. Nos. 3,532,214; 3,198,327; 3,552,559; 3,834,525; U.S. Pat. Re. 28,535; U.S. Pat. Nos. 3,650,394; 3,650,395; 3,817,373; 3,416,288; 3,747,749; 3,331,503; 3,302,784; 3,477,564; 3,756,397 and 3,217,874 are representative of packages with plastic overwrap. Most of these patents are concerned with the use of various transparent, nonfoam shrink wrap packages and to the use of various handles, "fingerholes" and adjunct supporting structures.

Multicontainer packages using this transparent thermoplastic films are suitable for many applications although there are marked disadvantages for the packaging of glass containers containing products such as beer which are sensitive to light. Furthermore such thermoplastic films do not provide a great deal of cushioning protection in handling. It is also quite difficult to decorate such transparent thermoplastic films and such packages often require the attachment of supplemental labels for the purpose of identification and decoration.

It is noted that U.S. Pat. No. 3,400,810 discloses the use of foam polystyrene for shrink wrapping of multicontainer packages. However, the foam polystyrene disclosed in this patent is biaxially oriented and will shrink in both directions. Such a shrunken overwrap will have the same strength properties in both directions making removal of the containers somewhat difficult. Furthermore it will be difficult to form a seal on the end flaps of the package cluster due to axial as well as circumferential shrinkage of the overwrap. It is noted that the packages illustrated in this patent engage only a small fraction of the end containers in the cluster. Moreover it is necessary for the patentee to use a very thick film in the neighborhood of 40 mils to achieve the required strength.

Thus it is the primary object of the present invention to provide an improved multicontainer merchandising package which is strong but yet is easily opened, opaque to light and is capable of being preprinted with information or decoration prior to application and requires no external structure for handling purposes.

In attaining the objects of this invention, one feature resides in a multiple container merchandising package comprising a group of similarly shaped containers held together in side-by-side fashion by a plastic overwrap comprising an opaque, uniaxially oriented, laminated composite sleeve which is uniaxially oriented in the circumferential direction and comprises a closed cellular (i.e. foam) thermoplastic polyolefin layer laminated to a noncellular thermoplastic polyolefin film, said sleeve circumscribing the containers and snugly engaging the tops of the containers in shrink fit relation.

An essential feature of the present invention is in the composition of the heat shrinkable polymeric sleeve, which is of a composite structure having a layer of a closed cellular (e.g. foam) olefin polymer adhered to a layer of a noncellular olefin polymer film wherein the cellular layer is on the inside of the sleeve and in engagement with at least the tops of containers and the film is on the outside of the sleeve and has a smooth, glossy decorated surface.

Other objects, features, and advantages of the present invention will be apparent from the description and drawings which follow wherein FIG. 1 is a perspective illustration of a "six-pack" of glass bottles packaged in accordance with the present invention;

Figure 1:
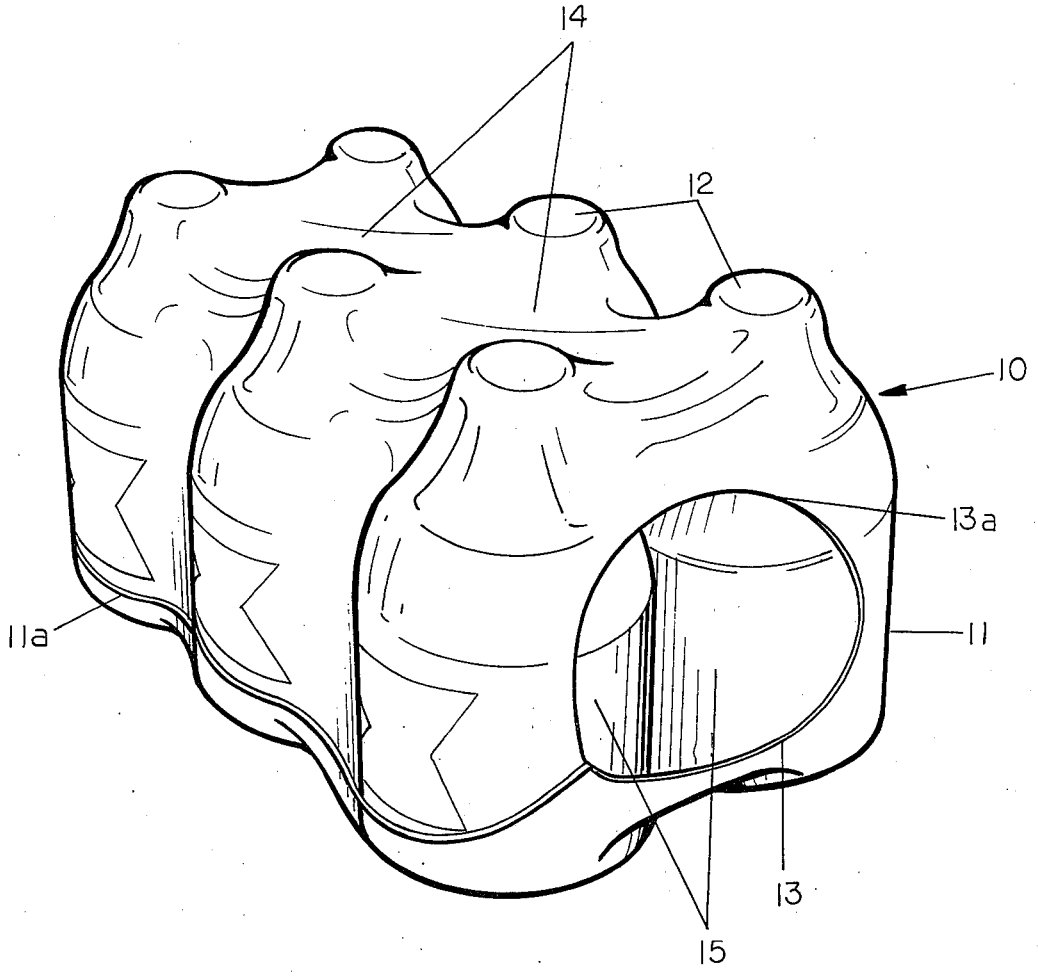
Figure 2:
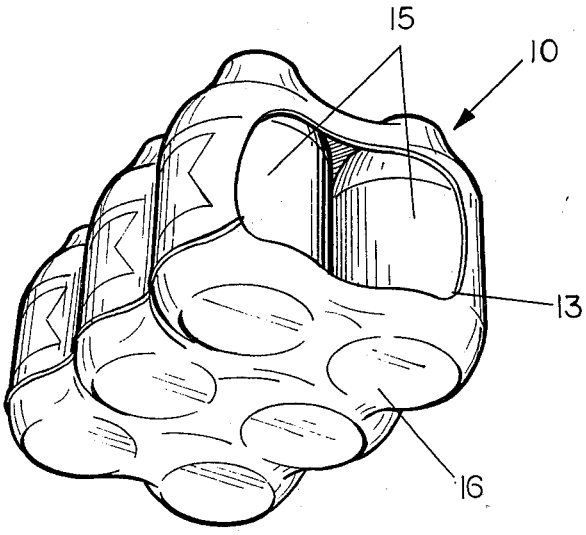
FIG. 2 is a bottom view of the package of FIG. 1.

Referring now to FIGS. 1 and 2 reference numeral 10 generally refers to the cluster package of six conventional upstanding one-way beer bottles 15 having similar cylindrical bodies. The containers are arranged in two adjacent rows each having three side-by-side containers.

As can be seen in FIG. 1 the tops 12 of the bottles 15 are snugly engaged by sleeve 11 and the bottles are contained and confined in all directions so as to prevent relative movement of the individual containers within the package. FIG. 2 illustrates how the bottoms 16 of bottles 15 are also snugly engaged by the sleeve. The heat shrunk opaque, overwrap sleeve of the invention is indicated by reference numeral 11 and is applied so that the direction of uniaxial orientation is in the circumferential or radial direction of the sleeve. Sleeve 11 is shown with decoration generally indicated by the letter "X". Such decoration is applied prior to wrapping the sleeve around the package.

The sealing seam of the sleeve is designated by **11*a*** and is shown as being positioned on the lower side of the package. The seam is formed by the use of adhesives or by thermally fusing edges of the sleeve together. The seam is positioned on the side of the package as a matter of convenience and could also be located at the bottom or top of the package.

The open end of the sleeve 11 defines an aperture 13 which is formed as the overlaying ends of the sleeve shrink and fuse together. The other end of the package (not shown) has similar configuration and appearance. In forming aperture 13 there is some shrinkage in the sleeve (e.g. less than 10%) in the axial direction and this assists in the formation of the tight package. If there were too much shrinkage in the axial direction, the aperture would be too large, and the sleeve would not effectively retain the bottles. In this regard it is important that the sleeve extend to cover the point of farthest extension of the container from the package so as to prevent container-to-container impact when several of such packages are transferred in end-to-end fashion on a conveyor. This point is approximately designated by the lead line for reference numeral 13 in FIG. 2.

The upper rim 13*a* of aperture 13 is quite functional and serves as a convenient gripping surface for transporting the package. Due to the nature of the uniaxially orientation, rim 13*a* is quite strong against the stress of lifting at this point and readily supports the weight of containers and their contents.

To open the package all one need do is punch a hole with the finger or other instrument through the top of the package at a point between tops 12 where the sleeve is tightly drawn. Such a point is generally illustrated by reference numeral 14. Once the sleeve is punctured in these areas it will readily tear in the circumferential direction and the bottles can be easily removed individually or in pairs. The sleeve is quite resistant to tearing in the axial direction so the package remains intact with respect to the remaining containers in the cluster.

Figure 3:
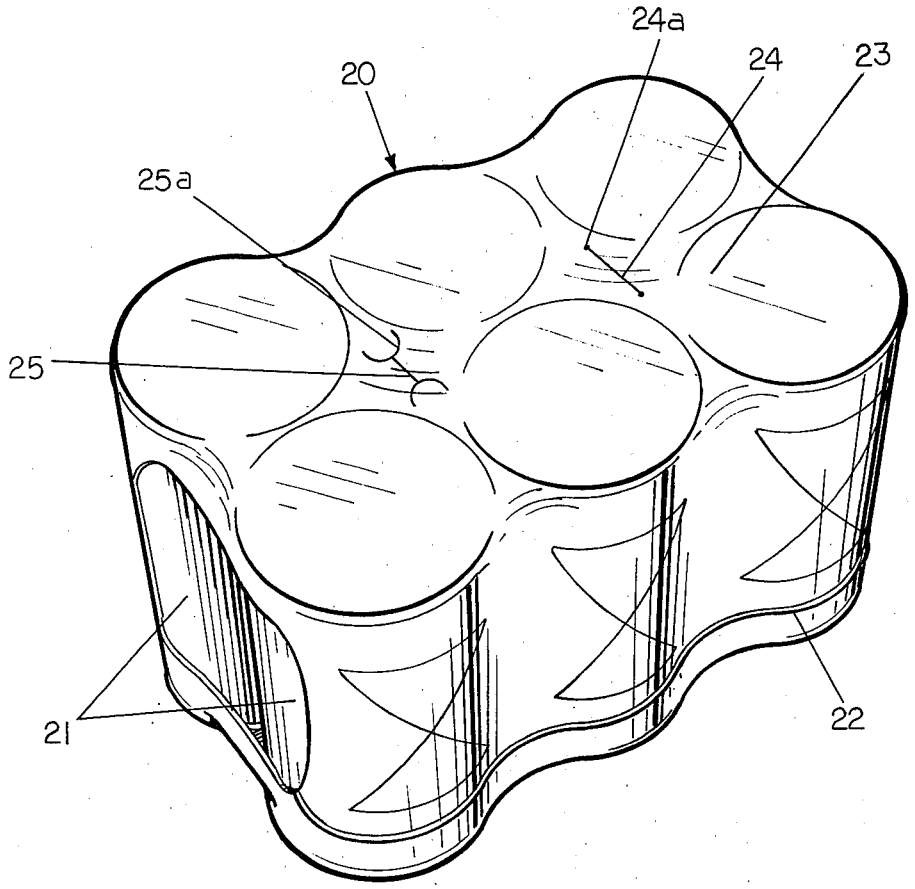
FIG. 3 is a perspective illustration of a six-pack of cans packaged in accordance with the present invention.

FIG. 3 generally illustrates a package 20 similar to that shown in FIGS. 1 and 2, except that the containers are in the form of cylindrical metal cans 21 rather than bottles. The sleeve 23 is otherwise as explained with respect to FIGS. 1 and 2 and is sealed together at seam 22.

FIG. 3 also illustrates how a finger opening can be used with the package of the invention if desired although the finger hole is not used in the presently preferred embodiment. Reference numeral 25 represents a finger slit which is cut in the circumferential direction on sleeve 23. The slit terminates in semicircular cuts 25*a* which serve to retard tearing in the circumferential direction upon carrying. It will be understood that some care must be exercised when carrying the package by finger slits. Reference numeral 24 represents another type of circumferential finger slit which is formed by pushing a hot loop of wire through the sleeve. Slit 24 is sealed by beaded edges 24*a* which are formed by contact with the hot wire. In practice it is likely that all the slits on one package will be of the same type.

Figure 4:
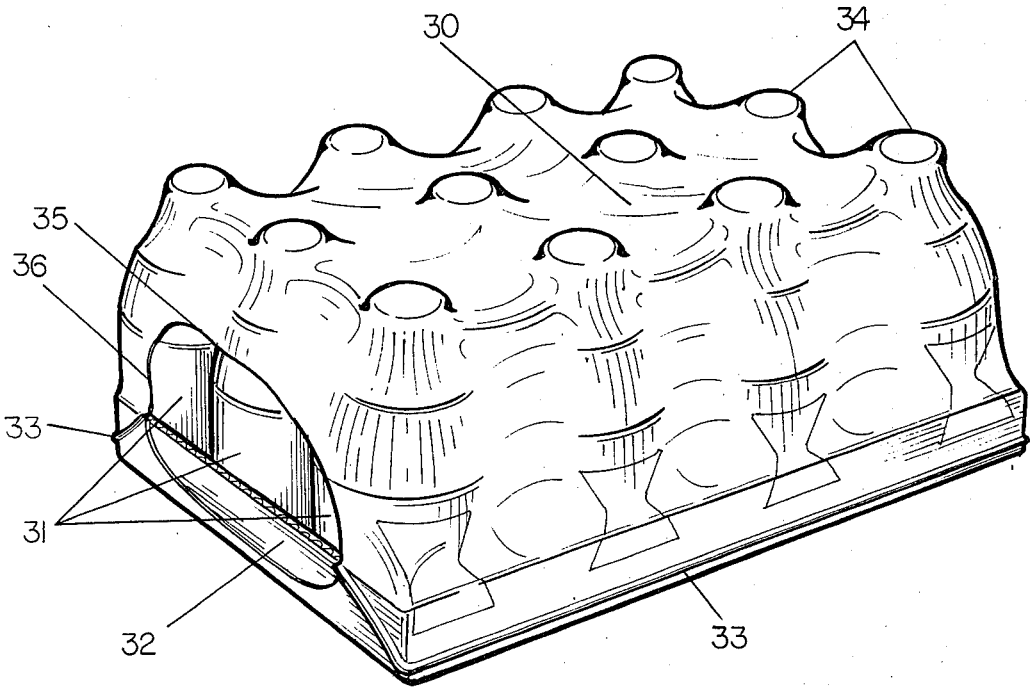
FIG. 4 is a perspective illustration of a 12-pack of glass beer bottles packaged in accordance with the present invention.

FIG. 4 generally illustrates a 12-pack 30 of one-way beer bottles arranged in three rows of four bottles each confined by sleeve 30 in tray 32. The package configuration is generally the same for that shown in FIGS. 1 and 2 except that the bottoms of containers 31 set in tray 32 which is shown as being made of corrugated fiber board. The outline of tray 32 is generally seen under the sleeve 30 and comprises a flat bottom panel provided with short upstanding side walls on all sides. Tray 32 is used for added package rigidity when more than two rows of containers are packaged to prevent relative displacement of the packaged containers with respect to each other. Due to the use of tray 32 only the tops 34 of the bottles are snugly engaged by sleeve 30 and the bottoms of the containers are held securely against the tray.

Sleeve 30 is applied so that the direction of uniaxially orientation is in the circumferential or radial direction of the sleeve and two sealing seams 33 are shown as being positioned on the lower part of the package overlaying the side wall portion of the tray 32. In this embodiment the sleeve is applied and sealed as two separate sheets. That part of the sleeve covering the bottom of the tray need not be foamed and can be any compatible thermoplastic film. In some embodiments it may be preferred to use a less expensive non-decorated thermoplastic film for covering the bottom of the tray. Furthermore transparent films can be used to cover the tray bottoms when it is desired or required to read specifications or other information printed on the tray bottom. As a further embodiment the sleeve can be formed by sealing the composite to the tray at the point where sealing seams 33 are located. In this embodiment the bottom of the tray serves as a part of the sleeve. It is thus apparent that the entire sleeve need not be made of the composite so long as the composite circumscribes the containers and snugly engages the tops of the containers in shrink fit relation. In this regard the term sleeve as used herein refers to this relationship.

As has been previously described with respect to FIG. 1 the rim 35 of the aperture 36 in the end of sleeve 30 provides a convenient handle for carrying. Most 12-packs would probably be too heavy to permit the use of finger holes. The end of the package which is not shown is identical in configuration to the end shown.

Figure 5:
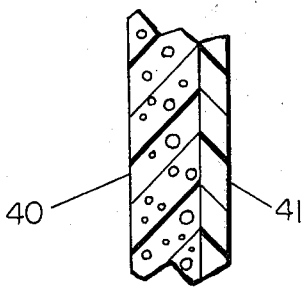
FIG. 5 is a cross sectional illustration of the composite laminate used as the overwrap in FIGS. 1 through 4.

FIG. 5 shows a cross sectional view of the sleeve of FIGS. 1 through 4 with 40 representing the foam or cellular layer and 41 representing the noncellular film laminated thereto. The total thickness of the laminate composite is usually in the range of about 3 mils to about 20 mils and preferably in the range of about 5 to about 15 mils for efficiency and economy. The cellular layer 40 is usually about 2 to about 5 times and preferably about 3 times the thickness of noncellular film 41 and noncellular layer 41 is usually positioned on the outside of the sleeve.

The polymeric materials respectively and independently contemplated for cellular layer 40 and noncellular layer 41 are olefin polymers; that is, each of these polymeric layers will have as the predominant polymeric moiety a polymer of an olefin, preferably an olefin having 2–4 carbons, or mixtures thereof, e.g. the predominant moiety will be a polymer of ethene, propene, butene, like butene-1, or mixtures thereof, more commonly referred to as a polymer of ethylene, propylene or butylene. This includes homopolymers, copolymers of these olefins with other copolymerizable monoethylenically unsaturated monomers, wherein the olefin in the copolymerization is such that the moiety thereof in the final copolymer, that is the ethylene, propylene or butylene moiety, is at least about 60% by weight, and polymeric blends, or admixtures, wherein the resulting polymeric blend is at least about 60% by weight of a polymerized olefin moiety, e.g. at least about 60% of an ethylene moiety in the blend. The minor amounts, i.e. less than about 40% of the other moiety of material employed, are such as to supplement and compliment the basic properties of the olefin polymer and this applies whether other moieties are introduced by way of a polymer blend, or admixture, or by way of a copolymerized monomer. These other moieties, whether supplied by blending another polymer with a homopolymerized olefin, e.g. homopolymerized ethene, (ethylene homopolymer), or by copolymerization therewith, should not be such as to significantly interfere with the foamable, heat sealable, heat shrinkable, extrudable characteristics of the base olefin polymer and should be compatible, i.e. miscible with it.

Exemplary olefin homopolymers are ethylene, propylene and butylene homopolymers, with the former being especially preferred, and blends of these homopolymers. The terms polyethylene, polypropylene and polybutylene are used herein to include those materials recognized and sold commercially under those names, even though those materials, strictly and technically, may be viewed by some to be a blend, or copolymer, since the materials may include small amounts, typically less than about 5%, e.g. 0.5–3% by weight, of another polymeric moiety. For example, polyethylene is sold and recognized by that name when in fact it may be produced by copolymerization with 1–2 percent by weight of hexene, or butadiene, or may, by analysis, show several percent, e.g. 3–5% of vinyl acetate moiety; for practical purposes however these materials consist of polyethylene. In this regard the composition of the sleeve used in the present invention is the same composition as the laminate described in commonly assigned copending application Ser. No. 504,111 filed Sept. 9, 1974 entitled "Container with Improved Heat Shrunk Cellular Sleeve".

The foregoing generally describes the composition of the polymeric portion of the cellular layer 40 and noncellular film 41, it being understood that the layers need not be of the same polymeric composition. It will, of course, be apparent that suitable adjuvants can be present in these layers if desired. Thus, for example in addition to the polymeric material, the respective layers can include pigments, stabilizers and the like. Generally, excellent results will be obtained by selecting a polymeric composition for cellular layer 40 which has a melt index or melt flow of less than 5, for example between about 0.1 to 5 and most desirably about 0.2 to 1 and the polymeric material selected for the noncellular layer 41 will have a melt index or melt flow of less than about 10. The preferred material for both the cellular layer and the noncellular layer is polyethylene, which includes low density polyethylene, for example polyethylene having a density of less than 0.925 grams/cc, generally in the range of about 0.910 to about 0.925, high density polyethylene, for example that having a density greater than about 0.941, typically about 0.941 to about 0.965, medium density polyethylene, and blends thereof. As regards the cellular layer, the density specified is prior to foaming. The foamed density of cellular layer is about 25–30 #/ft.$^3$ and the density of the composite laminate is about 35–40 #/ft.$^3$ As previously indicated the present invention is directed to an improvement in the hereinbefore-described packages wherein, in producing these packages, a heat shrinkable uniaxially oriented, laminated sheet is first prepared which is appropriately cut and slit and formed into rectilinear sheets which are then formed into a heat shrinkable sleeve which applied to the cluster of containers to produce the ultimate package. While a sheet of stock material of the composite structure for use herein can be formed by various techniques it is generally preferred to employ extrusion technology. This extrusion technology may take either of two conventional forms, one of which is extrusion coating and the other of which is the use of co-extrusion technology. The latter technique, however, is particularly highly preferred because of the apparent ability to form lower density composite structures. In the co-extrusion technique, while a slit die may be employed, the preferred practice is to employ an extrusion die which is possessed of an annular, circular opening and the composite structure is initially formed as a tubular shape by what is referred to in the art as a "blown bubble" technique. These types of co-extrusion dies are widely available commercially and an exemplary die is set forth in SPE Journal, November 1969, Vol. 25, page 20, entitled, "Co-Extrusion of Blown Film Laminates" and form no part of the present invention as such.

In this known co-extrusion technique the circular opening is fed from two independent extruders and, in this particular instance, the extruder supplying the foamable material, intended to form cellular layer 40, preferably will feed the die so that this material forms the internal portion of the tubular extrusion; the extruder feeding the material intended to form non-cellular layer 41 will preferably be fed to the die so as to form the external portion of the tubular shape. The tubular member issuing from the extruder is blown into a bubble by conventional "bubble" forming techniques, including air cooling of the external surface thereof, and is then drawn through the nip of two juxtaposed rollers wherein the tubular member is compressed to form a flattened tube.

Suitable convention foaming or blowing agents are employed to produce foaming and the cellular structure results, just as the extrudate leaves the die. This flattened tube is then contacted with cutting knives which slit the flattened tubular member along its edges (machine direction) so as to form a sheet or film of substantially uniform width; this sheet or film, which is at this point actually a sheet of two superimposed composite structures, for use herein, is separated into two independent sheets and wound onto independent winding wheels, which provides the stock of the heat shrinkable composite structure for use herein. Inasmuch as the sheet of the composite structure must possess heat shrinkable characteristics the appropriate heat shrinking in the machine direction of extrusion, which preferably is a major amount and is greater than the cross direction heat shrinkage, is primarily provided by the impetus of the rate of drawing of the flattened tube through the nip of the rolls, and using cooling air on the exterior of the bubble, and the cross direction shrinkage, which is less than the machine direction shrinkage, is primarily provided by the internal air employed in forming the bubble and external cooling air. This of course is known for forming heat shrinkable films.

The term "heat shrinkable" as used herein refers to the property of the laminated composite whereby it contracts in length and/or width upon exposure to sufficient heat. Shrinking is generally attributable to a reorientation of molecules which were previously oriented by stretching the sheet either uniaxially longitudinally (machine direction) or horizontally (transverse direction) or biaxially (both directions). In the practice of the present invention the laminated composite sleeve is said to be uniaxially oriented in the circumferential direction. This means that the sleeve is capable of shrinkage in the circumferential direction of at least about 2.5 times and preferably at least about 5 times the shrinkage in the axial direction. The sleeves of invention are capable of shrinking at least 50% and preferably at least 60% in the circumferential direction and less than 20% and preferably less than 10% in the axial direction. In a particularly preferred embodiment the sleeve is capable of shrinkage about 70% in the circumferential direction and about 6–8% in the axial direction. This shrinkage value is the theoretical value rather than the value which is experienced in forming a package. The theoretical values are determined by placing a sample of the composite in a hot bath of heat transfer liquid at 350° F. for 10 seconds and determining the resulting shrinkage. In actual practice the shrinkage is usually much less than theoretical due to the amount of the composite that is used to wrap the containers. For example a sheet of composite foam polyethylene and film polyethylene with a foam thickness of about 4.5 mils and a film thickness of about 1.5 mils, which is 21.5 inches long and about 11.5 inches wide forms the sleeve around a six-pack of one-way beer bottles when heated at 400° F. for 20 seconds. In such a package there is an actual shrinkage of about 50% in forming the aperture at the end of the pack, about 15% between bottles and only about 2% over the bottle tops.

The term "heat shrunk" describes the condition of a heat shrinkable material after application thereto of heat sufficient to cause relaxation and shrinkage (e.g. heating in an oven at 450° F. for about 5 seconds). This heat treatment heats the sleeve to near the melting point of the composite.

The sleeve can be applied by conventional methods wherein a plurality of containers are carried along a predetermined path which can be a pair of moving conveyors or other transport means to an arranging zone such as an indexer where the containers are arranged in the desired juxtaposed relation. Typically this relation is three rows of containers two abreast. The arranged containers are moved along a path away from the arranging station to a wrapping station where heat shrinkable composite laminate from a supply roll is placed around the arranged containers. The wrap is parallel to the longitudinal axis of the arranged container cluster or provided the ends of the outermost containers are within the volume defined by the sleeve after shrinkage.

The wrapped containers are then passed through a heating zone such as a shrink tunnel where heat sufficient to shrink the film is applied. The arranged containers held endwise and sidewise by the heat shrunk sleeve are then passed to a distribution area.

For convenience in disclosure, all patent documents and publications mentioned herein are incorporated by reference.

Having thus described the invention, what is claimed is:

1. A multiple container package comprising a plurality of upright filled and closed containers grouped in side-by-side engagement with their central axes substantially parallel and disposed normal to a longitudinal dimension of the package; and an open ended sleeve of preoriented, shrinkable thermoplastic material encircling said group of the containers disposed along the longitudinal dimension of the group and shrunken snugly about said group of containers covering substantially at least their longitudinal extent in the package;

said preoriented material of the sleeve being characterized as a substantially uniaxially oriented, opaque, laminated, thermoplastic material capable of shrinkage in the circumferential dimension of said sleve at least 2½ times shrinkage capability in the axial dimension thereof and being readily tearable in the circumferential direction and tear resistant in the axial direction;

said sleeve material comprising a cellular thermoplastic layer laminated to a noncellular thermoplastic film layer;

said sleeve in shrink-fit relation snugly engaging the group of containers circumferentially and axially of the package tightly holding them together in surface contact with each other and being in surface contact with a substantial portion of that part of each of the side, top and bottom surfaces of each container which surfaces constitute the exterior of said group; and said sleeve including at least one slit therein extending in the circumferential, readily tearable direction, said at least one slit extending along a plane extending between adjacent containers of said package, and a bead of said thermoplastic material at each end of said slit in alignment with each end of said slit to retard tearing of said sleeve in said circumferential direction and permit said slit to be used as a finger opening for carrying purposes;

whereby, containers may be removed from a portion of said package at one end thereof by tearing said sleeve about its circumference along a plane extending substantially between adjacent containers and separating one portion of said sleeve from the remaining portion of said sleeve such that the remaining portion of said package is left intact and constitutes a shorter package with respect to said longitudinal dimension.

2. The package of claim 1 wherein sleeve has a thickness of in the range of about 3 mils to about 20 mils.

3. The package of claim 2 wherein said sleeve has a thickness of about 5 to about 15 mils.

4. The package of claim 1 wherein said sleeve is decorated.

5. The package of claim 1 wherein said substantially uniaxially oriented sleeve is formed from a laminated composite capable of shrinkage in the circumferential direction at least about 5 times the amount of shrinkage in the axial direction.

6. The package of claim 1 wherein said open ended sleeve encircling said group of the containers disposed about the longitudinal dimension of the group defines opposing end apertures, the axial length of said sleeve being greater then the longitudinal dimension of the group of containers so as to extend beyond both ends thereof and shrunken snugly about said group of containers covering their longitudinal extent in the package and the containers at the ends of the group having their farthest extending endwise surfaces of the group covered thereby, to tightly hold the containers together endwise and sidewise in surface contact with each other, each of the end apertures of the sleeve in shrink-fit relation being substantially smaller in area than the surface area of the respective end of the package, whereby said containers of the package are protected against end-wise surface contact with containers of other packages.

7. The package of claim 1 wherein said cellular foam layer is on the inside of the package and said noncellular film layer is on the outside of the package.

8. The package of claim 1 wherein said sleeve material comprises a closed cellular thermoplastic layer laminated to a noncellular thermoplastic film layer.

9. The package of claim 8 wherein said thickness of said closed cellular layer is about 2 to about 5 times the thickness of said film.

10. The package of claim 8 wherein said thickness of said closed cellular layer is about 3 times the thickness of said film.

11. The package of claim 1 wherein said sleeve material comprises a cellular thermoplastic polyolefin layer laminated to a noncellular thermoplastic polyolefin film layer.

12. The package of claim 11 wherein said polyolefin layer is polyethylene.

13. The package of claim 11 wherein said polyolefin film is polyethylene.

14. The package of claim 12 wherein the containers are bottles.

15. The package of claim 12 wherein the containers are glass bottles.

16. The package of claim 12 wherein the containers are glass bottles filled with pressurized product.

17. The package of claim 12 wherein the containers are cylindrical metal cans.

18. A multiple container package comprising a plurality of upright filled and closed containers grouped in side-by-side engagement with their central axes substantially parallel and disposed normal to a longitudinal dimension of the package; and an open ended sleeve of preoriented, shrinkable thermoplastic material encircling said group of the containers disposed about the longitudinal dimension of the group and defining opposing end apertures;

the axial length of said sleeve being greater than the longitudinal dimension of the group of containers so as to extend beyond both ends thereof and shrunken snugly about said group of containers covering their longitudinal extent in the package and the containers at the ends of the group having their farthest extending endwise surfaces of the group covered thereby, each of the end apertures of the sleeve in shrink-fit relation being substantially smaller in area than the surface area of the respective end of the package;

said preoriented material of the sleeve being characterized as a substantially uniaxially oriented, opaque, laminated, thermoplastic material capable of shrinkage in the circumferential dimension of said sleeve at least $2\frac{1}{2}$ times shrinkage capability in the axial dimension thereof and being readily tearable in the circumferential direction and tear resistant in the axial direction;

said sleeve material comprising a closed cellular thermoplastic polyolefin layer laminated to a noncellular thermoplastic polyolefin film layer, said closed cellular foam layer being on the inside of the package and said noncellular film layer being on the outside of the package;

said sleeve in shrink-fit relation snugly engaging the group of containers circumferentially and axially of the package tightly holding them together endwise and sidewise in surface contact with each other and being in surface contact with a substantial portion of that part of each of the side, top and bottom surfaces of each container which surfaces constitute the exterior surface of said group, said containers of the package being protected against endwise surface contact with containers of other packages; and said sleeve including at least one slit therein extending in the circumferential, readily tearable direction, said at least one slit extending along a plane extending between adjacent containers of said package, and a bead of said thermoplastic material at each end of said slit in alignment with each end of said slit to retard tearing of said sleeve in said circumferential direction and permit said slit to be used as a finger opening for carrying purposes;

whereby, containers may be removed from a portion of said package at one end thereof by tearing said sleeve about its circumference along a plane extending substantially between adjacent containers and separating one portion of said sleeve from the remaining portion of said sleeve such that the remaining portion of said package is left intact and constitutes a shorter package with respect to said longitudinal dimension.

* * * * *